United States Patent [19]

Kieffer et al.

[11] 4,005,772

[45] Feb. 1, 1977

[54] AUTOMATIC JUSTIFYING TYPEWRITER HAVING PITCH CHANGING AND LINE SPACING APPARATUS

[75] Inventors: John B. Kieffer, Riverton, Wyo.; Gregory G. Vogel, Lewisville, Tex.; Raymond B. Larsen, Riverton, Wyo.

[73] Assignee: Harris Corporation, Cleveland, Ohio

[22] Filed: June 13, 1975

[21] Appl. No.: 586,758

Related U.S. Application Data

[63] Continuation of Ser. No. 296,934, Oct. 12, 1972, abandoned.

[52] U.S. Cl. ..... 197/84 R; 197/19; 197/187

[51] Int. Cl.[2] ..... B41J 19/58

[58] Field of Search ..... 197/19, 20, 84 R, 84 A, 197/84 B, 114 R, 138 R, 187, 48, 49, 82

[56] References Cited

UNITED STATES PATENTS

| | | | |
|---|---|---|---|
| 2,379,862 | 7/1945 | Bush | 197/84 A |
| 3,346,087 | 10/1967 | Colombo et al. | 197/187 X |
| 3,354,816 | 11/1967 | Giannuzzi | 197/84 R X |
| 3,374,873 | 3/1968 | Takenaka | 197/49 |
| 3,578,129 | 5/1971 | Kato et al. | 197/19 |
| 3,583,540 | 6/1971 | Bernard | 197/138 R |
| 3,710,913 | 1/1973 | Brennan et al. | 197/82 |

*Primary Examiner*—Ralph T. Rader
*Attorney, Agent, or Firm*—Reilly & Hancock

[57] ABSTRACT

Automatic justifying typewriter includes incremental drive means operatively coupled to a printer for effecting controlled horizontal and vertical movement between a printout sheet and the character printing means. The operation of the printer and the drive means may be controlled either by direct keyboard entry or by coded printing operation and spacing operation control signals from a data source, such as, a computer programmed to prearrange the data, assign a preselected horizontal space to each printing character and compute the horizontal space between words for a preselected line length. The coded control signals control the drive means so that after each character is printed, the drive means will advance the character printing means a preselected number of times for that character; and at the end of each line the drive means will index a preselected number of times according to a predetermined setting.

12 Claims, 7 Drawing Figures

AUTOMATIC JUSTIFYING TYPEWRITER HAVING PITCH CHANGING AND LINE SPACING APPARATUS

This is a continuation of application Ser. No. 296,934, filed Oct. 12, 1972, now abandoned.

BACKGROUND OF THE INVENTION

This invention relates generally to a typewriter and more particularly to a novel and improved justifying typewriter capable of preparing automatically a justified line printout comparable in uniformity and aesthetic value to that of conventional typesetting apparatus.

The hard copy printout of a conventional typewriter is lacking in quality when compared to the typesetting process. The conventional typewriter has fixed escapement to establish the same horizontal space for all characters. This invention provides for automatic variable escapment adjusting the spacing for different width characters and provides automatic justificaton of right and left margins by automatic calculation of spaces between words. The printout of the conventional typewriter is less economical than the typesetting process in that it does not efficiently utilize the full space available on the printout sheet. A number of conventional mechanical and electric typewriters have the printout sheet advanced by the carriage relative to the type bar which impacts the sheet; and more recently, other typewriters have utilized a single element spherical printing head, such as, that employed in the Model 745 IBM Selectric typewriter. In this form the printing head is moved relative to the sheet as it prints. Broadly, a preferred embodiment of the present invention utilizes a Mode 745 IBM Selectric typewriter which is modified to operate as a typographical machine to produce a typewritten printout comparable to that set by a typographer and is characterized by automatically regulating the spacing between characters, words and justified lines in a continuous printout.

Accordingly, it is a general object of the present invention to provide a novel and improved form of an automatic justifying typewriter capable of producing a high quality printout utilizing the printing apparatus of a conventional typewriter.

Another object of this invention is to provide a novel and improved form of an automatic justifying typewriter which may be readily set up for printing out different type sizes, styles and weights of characters.

Yet a further object of this invention is to provide a novel automatic justifying typewriter capable of having the printing information input from a conventional typewriter keyboard which utilizes a computer to prearrange the characters for a proportionally spaced, justified line printout.

Still a further object of this invention is to provide a novel automatic justifying typewriter having a range of horizontal space settings coordinated with the various type fonts and utilizing first incremental drive means for the carriage as well as incremental drive means for positioning the printout sheet in the proper position relative to the character printing means.

A further object of this invention is to provide a novel automatic justifying typewriter capable of on-line operation with a computer or other memory or data source.

Yet a further object of the present invention is to provide a novel automatic justifying typewriter characterized by having incremental drive means operatively associated with the printer for effecting relative horizontal and vertical movement between the character printing means and the printout sheet, the actuation of the printer and incremental drive means being controlled by coded printing control signals and spacing control signals from a data source which automatically regulates the spacing between characters, words and lines according to preassigned values.

In accordance with the present invention, in a preferred form there is provided a keyboard printer conventionally of the type having a single element print head on a horizontally movable carriage and a printout sheet selectively engaged by the printing head. Incremental drive means are defined by a horizontal stepping motor coupled to the carriage and a vertical stepping motor coupled to the platen. A computer serves as a data source which is programmed to generate coded signals for controlling both the printing operations and motor stepping operations so that after each printing operation there is a spacing operation and, after each character is printed, the horizontal stepping motor advances the carriage a preselected horizontal distance called pitch proportional to the width of that character before the next character is printed. After each line is printed the vertical stepping motor is caused to rotate or index the platen through a variable preselected angle of rotation. Logic circuits are used to selectively actuate the printer, horizontal stepping motor and vertical stepping motor in the proper sequence. Most desirably, a gear shift mechanism is associated with the horizontal stepping motor to facilitate pitch adjustment of the horizontal space increment for a particular type font.

Other objects, advantages and capabilities of the present invention will become more apparent as the description proceeds taken in conjunction with the accompanying drawings.

DETAILED DESCRIPTION OF THE PREFERRED EMBODIMENT

Figure 1:
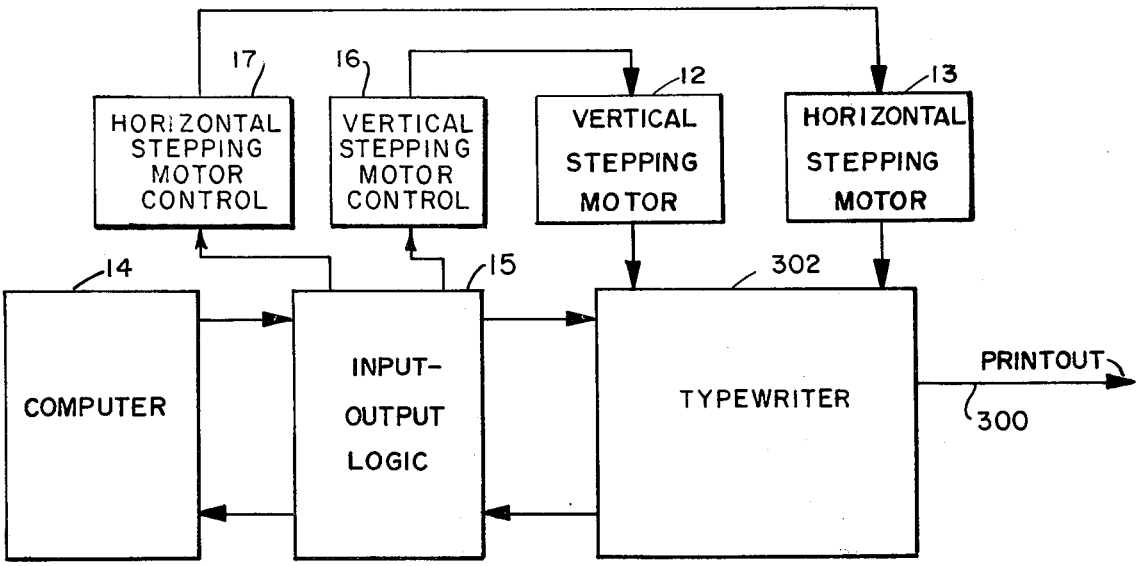
FIG. 1 is a general block diagram broadly illustrating the interrelationship between sections of an automatic justifying typewriter having pitch changing and line spacing apparatus in accordance with the present invention.
Figure 4:
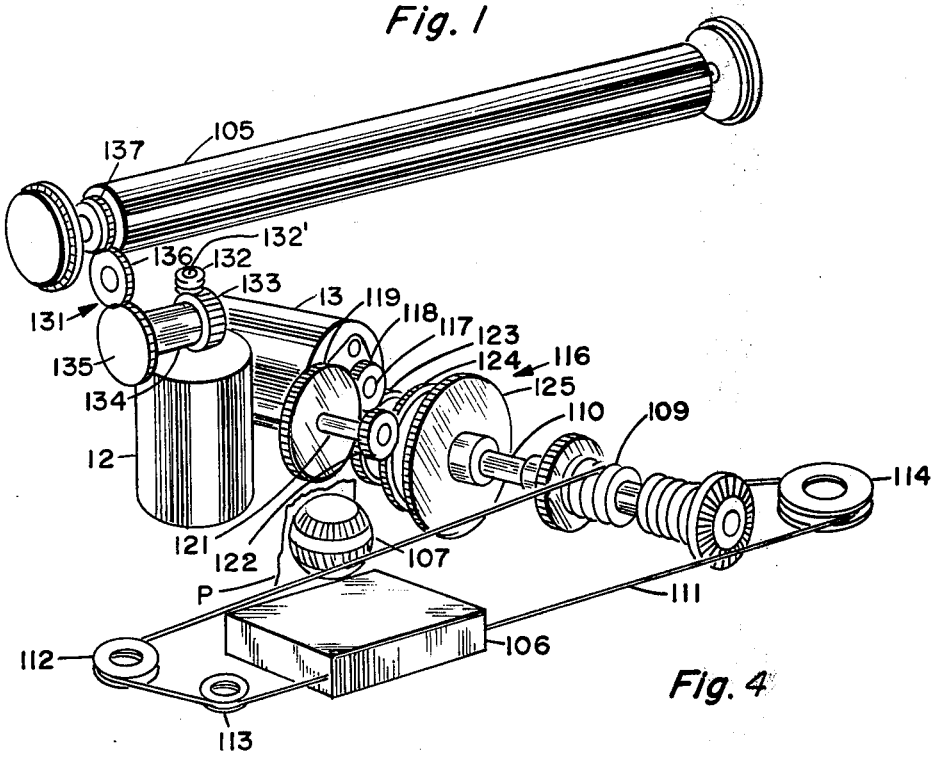
FIG. 4 is a diagrammatic perspective view of a portion of the apparatus in a conventional Model 745 IBM Selectric typewriter having added thereto horizontal and vertical stepping motors.

Referring to FIG. 1, and as a setting for the present invention, the general arrangement of the justifying typewriter having pitch changing and line spacing apparatus is illustrated in block diagram form to include a typewriter 302, a vertical stepping motor 12 and a horizontal stepping motor 13 which are both coupled to the typewriter 302 in a manner to be described. A suitable data source is illustrated in the form of a computer 14, and input/output logic circuit 15 is interfaced between the typewriter 302 and the computer 14. A pair of motor control circuits represented at 16 and 17 each receive suitable control signals from the computer 14 through the input/output logic circuit 15 to control the operation of the stepping motors 12 and 13, respectively. The typewriter 302 may be, for example, a model 745 IBM Selectric typewriter to coded signals received from computer 14 both for performing functional operations in the typewriter 302 such as space, backspace, shift, index and carriage return, as well as for actuating, spherical print head 107, as shown in FIG. 4, in printing each character. Moreover, the typewriter 302 as conventionally employed in association with a computer 14 or other memory data source transmits to the computer 14 coded signals representing each character printed or function performed. The coded control signals applied to the typewriter for character printing operations may for example be a six-line binary code set which together with the other coded control signals for controlling the functional operations of the typewriter 302 are applied from the computer 14 or other memory source through the input/output logic circuit 15. In addition, in a manner to be hereinafter described, coded spacing control signals from the computer 14, which regulate the spacing between characters, words and lines in the printout 300 are applied through the input/output logic circuit 15 to the stepping motor control circuits 16 and 17 for regulating the stepping operations of the stepping motors 12 and 13 and which control circuits 16 and 17 and stepping motors 2 and 13 define the incremental drive means for spacing within the typewriter 302. The input/output logic circuit 15 is operative to decode and sort the various control signals from the computer 14 in the proper sequence in relation to the printing and functional operations to be performed so as to result in a proportionally spaced, justified copy printout 300. In accordance with the present invention, the IBM Selectric typewriter 302 is modified in a manner to be more fully described by the incorporation of vertical and horizontal stepping motors 12 and 13 together with the associated stepping motor control circuits 16 and 17, respectively, to perform the required horizontal spacing and vertical index operations in the typewriter 302.

Figure 2:
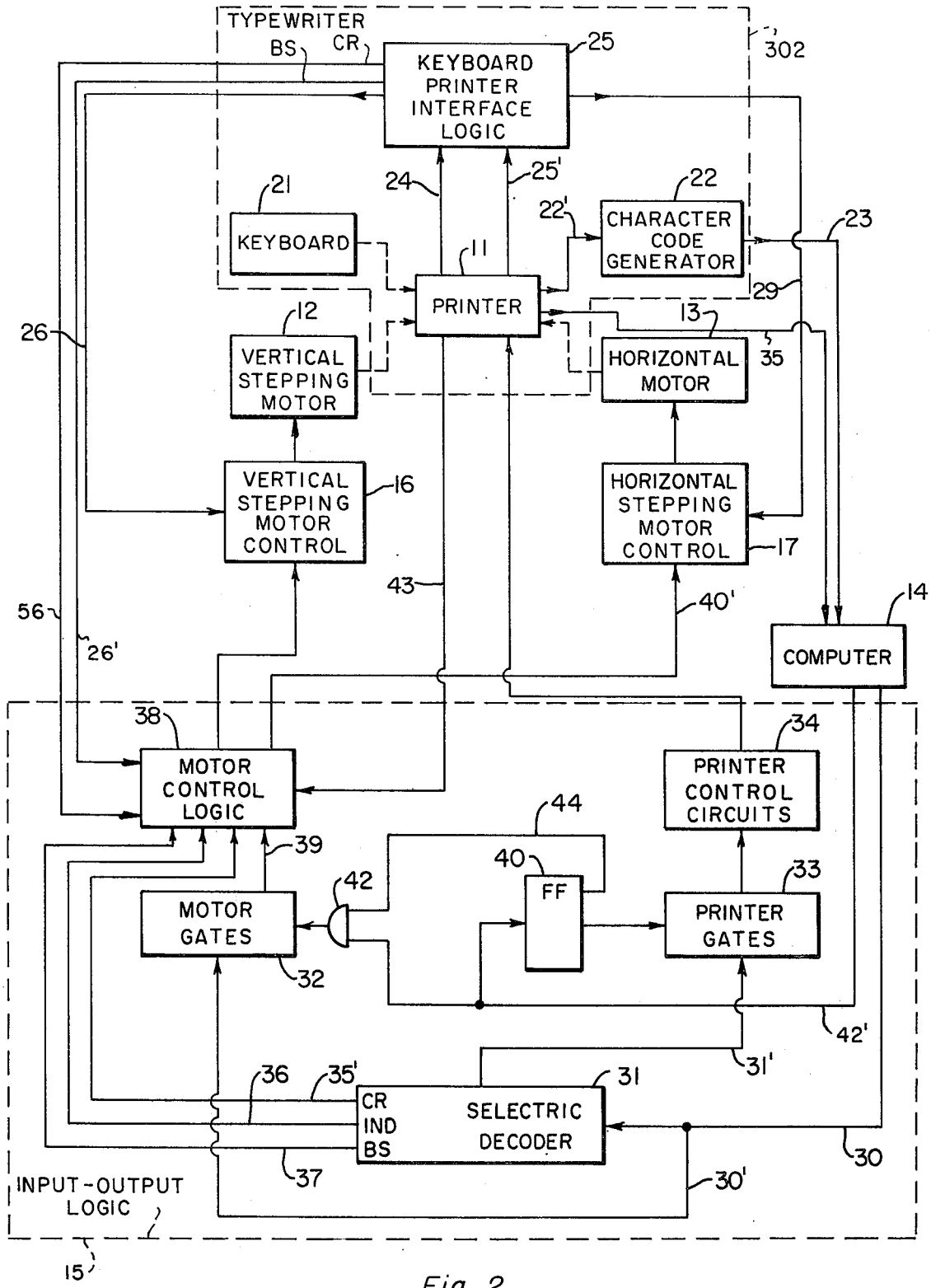
FIG. 2 is a more detailed block diagram of the automatic justifying typewriter of the present invention, those elements mechanically linked together being represented by dotted connecting lines.

Referring now to FIG. 2, the preferred form of system is schematically represented in more detail to illustrate the manner in which the text or data is first entered manually from the keyboard 21 of typewriter 302 into the computer 14 then is transmitted in combination with proportional spacing signals in accordance with this invention into the same typewriter 302 or other similar modified typewriter. The keyboard 21 represents the manual key lever portion of a Model 745 IBM Selectric typewriter which is mechanically linked to the printer 11 and which in turn activate the spherical print head 107 in the printer 11 in order to impress the character on the printout 300 corresponding to that of the key depressed in keyboard 21. The character code generator 22 can be any output circuit which in a conventional manner will generate coded character signals in response to closing of selected printer switches, not shown, associated with the printer 11 and which signals are transmitted over printer switch line 22 to the character code generator 22. The coded character signals generated by the character code generator 22 are in turn transmitted over the data entry line 23 into the computer 14. The printer switches are also electrically connected to the keyboard/printer interface logic 25 over line 25′ from the printer 11; and in addition, the various functional operations performed in the keyboard 21, such as, index, space, backspace, shift and carriage return are transmitted over a series of control lines represented by the line 24 to the interface logic circuit 25. The interface logic circuit 25 discriminates between the character and functional operations performed on the keyboard 21 to generate a fixed number of pulses according to the operation to be performed and applies the pulses either over a fixed vertical pulse line 26 or a horizontal pulse line 29. As shown, the pulse line 26 applies the pulses to vertical stepping motor control 16 for control of the vertical stepping motor 12. In turn, the pulse line 29 applies the pulses to horizontal stepping motor control 17 for the horizontal stepping motor 13. In addition, the horizontal pulse line 29 will apply directional control signals to the horizontal stepping motor control 17 to regulate forward or reverse spacing for a space or backspace command, respectively, as well as a disabling pulse or control signal which is operative to disable the horizontal stepping motor 13 in response to a carriage return operation to permit the carriage, such as carriage 106 represented in FIG. 4, to be driven to the lefthand margin by a conventional mechanism (not shown). The printer switches are electrically connected to the interface logic 25 as described in order to direct the interface logic 25 to apply a fixed number of pulses to the horizontal stepping motor control 17 in advancing the carriage 106 after printing of each character.

Thus, in manual keyboarding it will be appreciated that the interface logic circuit 25 will transmit the fixed pulses to the stepping motor circuits control circuits 16 and 17 in advancing the platen 105 and carriage 106 in vertical and horizontal directions, respectively, between lines, words and characters. Alternately, the spacing function during manual keyboarding may be performed under command of the computer 14 as the information typed is entered into the computer 14 from the character code logic circuit 22 and in this way provide proportional spacing features in a manner now to be described.

Again, referring to FIG. 2, as the data is entered from the keyboard 21 through the character code generator 22 into the computer 14 and subsequently encoded from the computer 14 into the printer 11, proportional printing is accomplished in a unique manner through the stepping motors 12 and 13 in which horizontal stepping motor means 13 will incrementally advance the carriage 106 preselected horizontal distances proportional to the widths of the characters printed, or vertical stepping motor drive means 12 will rotate the platen 105 through a predetermined angle of rotation following the printing of each line. It will be helpful to an understanding of the proportional printing or spacing operations to consider the manner in which the computer 14 or other memory source may be programmed to apply both the coded character signals as well as the spacing signal stored in the computer 14 over a data entry line 30 in order to sequentially control the horizontal and vertical advancement of the printer 11. By way of illustration, the program for the computer 14 may be written with a spacing code to establish a fixed number of horizontally spaced increments or units for each character as well as to calculate the number of spacing units between words for a particular line length. In the following, illustrative spacing units for the IBM Selectric Composer fonts are set forth for each character to be printed.

| | | |
|---|---|---|
| A - 8 | a - 5 | . - 3 |
| B - 7 | b - 6 | , - 3 |
| C - 7 | c - 5 | : - 4 |
| D - 8 | d - 6 | ; - 3 |
| E - 7 | e - 5 | ' - 3 |
| F - 7 | f - 4 | ' - 3 |
| G - 8 | g - 5 | * - 6 |
| H - 8 | h - 6 | † - 6 |
| I - 4 | i - 3 | ( - 4 |
| J - 5 | j - 3 | ) - 4 |
| K - 8 | k - 6 | ! - 4 |
| L - 7 | l - 3 | $ - 6 |
| M - 9 | m - 9 | + - 6 |
| N - 8 | n - 6 | / - 4 |
| 0 - 8 | o - 6 | ? - 5 |
| P - 6 | p - 6 | - - 3 |
| Q - 8 | q - 6 | ¾ - 8 |
| R - 8 | r - 4 | ½ - 8 |
| S - 7 | s - 4 | & - 8 |
| T - 7 | t - 4 | — - 8 |
| U - 8 | u - 6 | % - 8 |
| V - 8 | v - 5 | = - 6 |
| W - 9 | w - 8 | [ - 5 |
| X - 8 | x - 6 | ] - 6 |
| Y - 8 | y - 6 | @ - 8 |
| Z - 7 | z - 5 | ¼ - 8 |

All Presswire Font characters have the same unit values as the "Selectric" Composer Fonts with the exception of the following:

| | |
|---|---|
| All numbers = 4 units | % = 6 units |
| Composite fraction denominators = 8 units | & = 6 units |
| Composite fraction numerators | $ = 4 units |
| 1 = 5 units | + = 8 units |
| 3 and 7 = 8 units | |
| 5 = 6 units | |

Every character code will be followed by a space code so that every odd numbered signal is a character signal and every even numbered signal is a spacing signal; and when the text or printing data is entered from the keyboard 21, the initial conditions of spacing for each character, line length and index are simultaneously entered.

In order to initiate the justified typing the final copy sheet into the printer 11 and will command signal to the computer 14 by activating a conventional key in keyboard 21. The computer 14 will then transmit over data line 30 the text information or data, for example, as a six-bit input code, each character signal being followed by a spacing or other signal which is decoded and routed by selectric decoder 31 either over printer line 31' to the printer 11 or to the control mechanism to be described for performing the desired spacing and other functional operations in the printer 11. In establishing the necessary program, a look-up table may be employed which will associate with each character a code representing the number of incremental spacing units for that character. Also, in order to set up a given line length, the computer 14 must determine the number of units as represented by the characters in a line and subtract that number from the total number available in a line. This number is then divided by the number of spaces between words in a line so that the resultant number will represent the number of spacing units between words in the line. For instance, if a line is to be made up of 170 units, and the characters make up 130 units of the total, the 40 remaining units are divided by the number of spaces between words. Thus, for six words in a given line, there will be five spaces between words, and the 40 remaining units divided by the five spaces will result in a total of eight units for each space between words. Following the last character in each word, the computer 14 is therefore programmed to deliver a command signal to incrementally advance the carriage 106 eight spaces prior to impression of the first character of the next word in succession. Of course, the computer 14 may be programmed in a conventional manner to deliver other instructions. For example, fixed spacing codes between words may be delivered by the computer 14 where it is not necessary to desirable to justify a given line, such as, at the end of a paragraph. Moreover, the computer 14 may be instructed to supply a fixed number of spacing increments prior to a space or character code, such as, where indentation is required.

In the example given, every signal following a character coded signal or a signal representing a functional operation of the typewriter, such as, backspace, index, carriage return is a horizontal spacing signal. Once again considering the space signals for each character, most desirably each character is assigned a fixed horizontal space made up of a selected number of increments or units for the carriage control mechanism which remains constant. This will greatly simplify programming of the computer 14 in assigning a specific horizontal spacing for each character which is the same irrespective of the size of print.

As schematically illustrated in FIG. 2, the coded character and spacing signals are applied over the data entry line 30 to the decoder 31 and over an associated input line 30' to motor gating circuit 32. Again, the computer 14 is programmed to transmit in succession a print command and a space command; and the decoder 31 is so designed that every print command is transmitted to the printer 11, and every spacing command is transmitted to the horizontal stepping motor 13. Each signal or command is accompanied by a data transfer or "prepare to receive" pulse over input line 42' from the computer 14.

More specifically, each print command is transmitted from the decoder 31 over print line 31' to printer gate circuit 33 into the printer control circuits represented at 34. The printer control circuits 34 may suitably consist, for example, of printer solenoid drivers, not shown, which are energized in different combinations according to the signal received to activate a corresponding combination of bails in the printer 11 for printing the character represented by the signal, all in accordance with conventional practice. Certain commands represent special functions, such as, carriage return, index, backspace, shift and tab. For the purpose of illustration, the carriage return line 35', index line 36 and backspace line 37 are shown leading from the decoder 31 to motor control logic circuit 38. The motor gating circuit 32 is selectively enabled in a manner to be described to transmit each alternate signal received over the input line 30′ to the horizontal space line 39 which is connected from the output of the motor gating circuit 32 to the motor control logic circuit 38, and the logic circuit 38 in turn transmits a predetermined number of signals corresponding to the space command received over line 39 to the horizontal stepping motor control 17.

The sequence of transmission of the print and space commands or signals is controlled by flipflop 40, the latter being toggled by each pulse applied over input line 42′ to alternately enable the printer gate circuit 33 and the motor gating circuit 32. Thus, when the flip-flop 40 is set by a data transfer pulse the motor gating circuit 32 is then enabled by AND gate 42 to transmit a space command signal over line 39 to motor control logic circuit 38. The flip-flop 40 is reset by the next data transfer pulse to enable the printer gate circuit 33 and to transmit the next signal as a print command to the printer control circuits 34. It will be noted that if the print command is in fact a signal to perform a functonal operation, such as, backspace, carriage return or index, its coding is such that it will not activate the printer control circuits 34; however, it will activate one of the stepping motor control circuits 16 and 17 through the motor control logic circuit 38. In a similar manner, in certain cases where a space or print command is not required, a dummy command is programmed into the computer 14.

Briefly summarizing the operation of the logical circuitry in automatic printing and proportional spacing operations, each print command preferably is followed by a spacing command. For instance, at the end of each character printed, the horizontal stepping motor 13 will proportionally space the carriage 106 according to the width of the character printed. At the end of a word, once again the horizontal stepping motor 13 will space a predetermined number of units or increments according to the spacing established for justified line printout. At the end of a line, a space command is delivered after the last character in the line followed by a carriage return command which will index the platen 105 to the next line. A special condition is set up for the carriage return signal which in addition to indexing the platen 105 through the vertical stepping motor 12 will effect closure of a conventional carriage return interlock switch not shown in the printer 11 to apply a signal over line 43 to the motor control logic circuit 38 and cause the motor control logic circuit 38 to transmit a disabling signal on lead 40′ to the horizontal stepping motor control 17 to disengage the horizontal stepping motor 13 from the carriage 106 and permit the carriage to be returned to the lefthand margin such as by a conventional carriage return spring, not shown. For indexing the typewriter other than for carriage return operations, the index signal is followed by an indexing spacing or dummy command as desired. A shift signal which is transmitted as a print command also may be followed by a dummy space command to maintain the desired sequence of signals and the same may be true of the tab and space commands. In the case of the tab and space signals however, each may be followed by an escapement space command if desired, depending upon the programming established in the computer 14.

Figure 3:
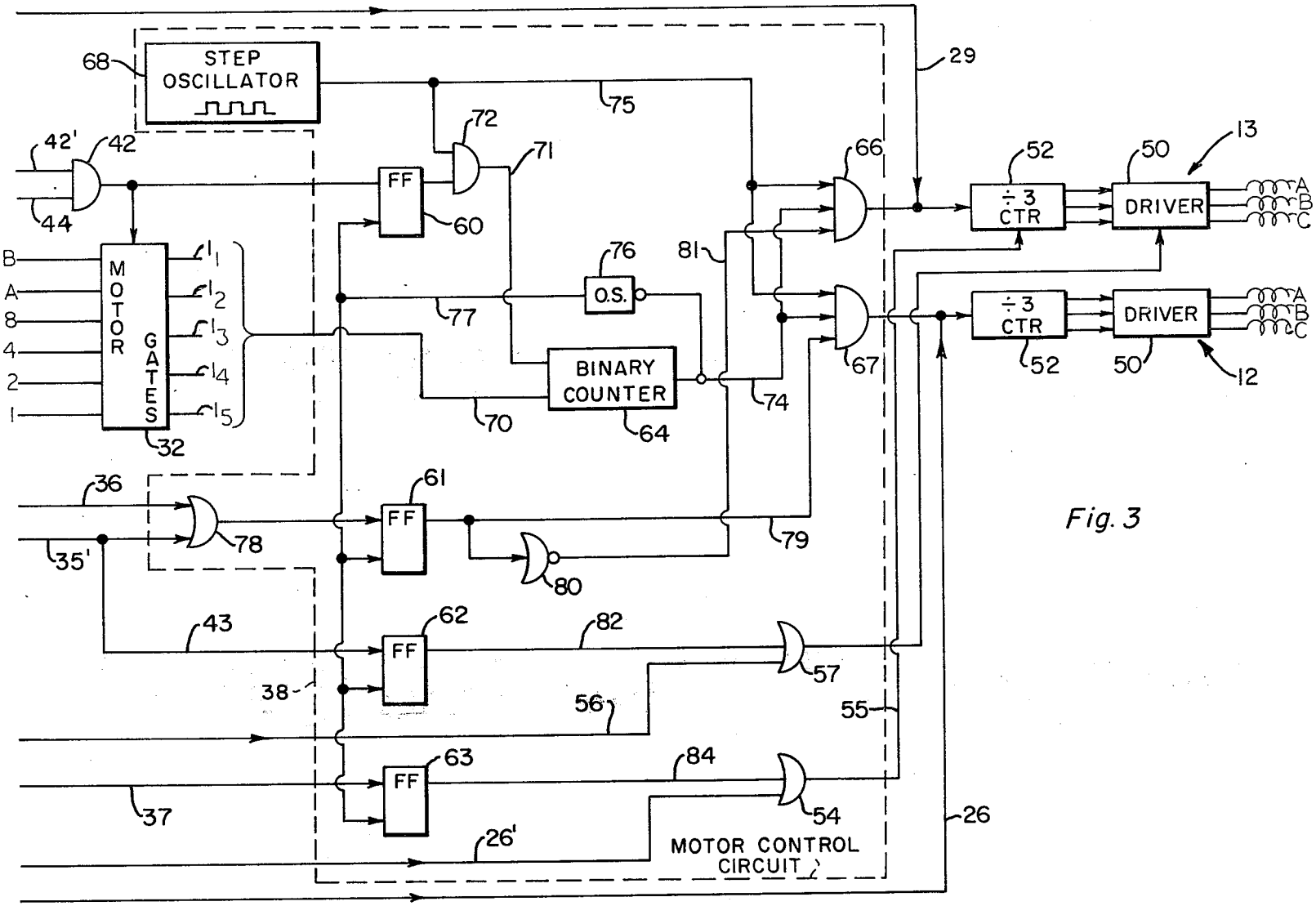
FIG. 3 is a logic circuit diagram for decoding and routing the signals to alternately actuate the printer and stepping motors through the motor control logic circuit shown in FIG. 2.

A preferred form of the horizontal and vertical stepping motor control logic circuits 16 and 17 is shown in FIG. 3 to illustrate in more detail the manner in which the horizontal and vertical stepping motors 12 and 13 may be activated either by fixed pulses during manual keyboard entry or by space command pulses when the information is encoded from the computer 14. Each of the stepping motors 12 and 13 is represented as having windings A, B, C energized by a driver 50 which amplifies pulses applied through a conventional divide-by-three counter 52, the latter controlling the sequence of energization of the windings A, B, and C and accordingly the direction of stepping of each stepping motor 12 and 13. Thus when the horizontal stepping motor 13 is to be advanced clockwise, the motor windings are switched in the sequence A, B, C; however when the horizontal stepping motor 13 is to advance counterclockwise the motor windings are switched in the opposite sequence C, B, A. For instance, the motor windings A, B, C of the horizontal stepping motor 13 would be reversed for stepping in a counterclockwise direction when a backspace command is received.

During manual keyboard entry, the fixed horizontal pulses are applied over line 29 to the counter 52 for the horizontal stepping motor 13, and fixed vertical pulses are applied over line 26 to the vertical stepping motor 12. In turn, the backspace pulses are delivered over line 26′ through an OR gate 54 and output line 55 to the counter 52 for the horizontal stepping motor 13 in such a way as to drive the horizontal stepping motor 13 in a reverse direction. In addition, the "driver disable" pulses are delivered over line 56 through OR gate 57 and an output line 58 to the driver 50 for the horizontal stepping motor 13 in order to disable the horizontal stepping motor 13 during a carriage return operation.

Under automatic or computer-controlled operations, the sequence of printing and spacing as well as the number of spaces is controlled through a combination of flip-flop circuits 60 to 63 which cooperate with a binary counter 64 as well as AND gates 66 and 67 to select and regulate the number of pulses applied to either of the stepping motors 12 or 13 from a step oscillator 68. Referring back to FIG. 2, the data input lines 30 and 30′ collectively represent the input code signals which are transmitted from the computer 14 and which for example, may be designated B, A, 8, 4, 2, 1 inputs to motor gating circuit 32 of FIG. 3. It will be recalled that the motor gating circuit 32 is activated by an enabling signal from AND gate 42 which in turn is enabled by data transfer and motor gate enabling pulses over lines 42′ and 44. When so enabled, space command signals are output over lines $I_1$, $I_2$, $I_3$, $I_4$ and $I_5$. Essentially the space commands are coded such that they will load a predetermined number of counts into the binary counter 64 over a count preset line 70. The binary counter 64 also has a step input line 71 from AND gate 72 which is enabled by inputs from the set side of the flip-flop 60 and the step oscillator 68 so that only the remaining number of stepped after loading will be applied from the binary counter 64 over an output line 74 to the AND gates 66 and 67. Each time that an AND gate 66 or 67 is enabled by steps from the binary counter 64, a pulse is applied from the oscillator 68 directly over line 75 to step one of the stepping motors 12 or 13 a corresponding number of times. At the end of the count, a oneshot delay 76 is operative to reset the flip-flops 60 to 63 by a signal applied to the reset line 77.

In advancing either of the stepping motors 12 and 13, selection of one of the AND gates 66 and 67 is determined in part by the condition of the flip-flop 61. The carriage return and index lines 35′ and 36, respectively, are input through OR gate 78 to the set side of the flipflop 61, and upon arrival of a signal over either line 36 or 35, an enabling pulse is directed over line 79 to the AND gate 67; however, the AND gate 66 is gated low or off from the output of the NOR gate 80 through input line 81 to the AND gate 66. In the absence of a signal applied over lines 35′ or 36, the flip-flop 61 will remain in a reset condition and the AND gate 67 is gated low and AND gate 66 is gated high by a signal from the NOR gate 80.

"Drive Disable" pulses from the line 43 are applied to the set side of the flip-flop 62 and, through line 82, to one input of the OR gate 57 to disable the driver 50 in the same manner as described with reference to the manual control pulses delivered along line 56. Again, in this way, the driver 50 is disabled for the carriage return operation; and the carriage 106 is free to be returned to its lefthand margin. Backspace pulses from line 37 operate to set the flip-flop 63 and through control line 84 enable the OR gate 54 to activate the counter 52 for the horizontal stepping motor 13. As previously explained, any flip-flop 60, 61, 62 and 63 which is set to initiate a particular operation is reset by the one-shot 76 at the end of that operation or completion of the counts by the binary counter 64.

In a preferred embodiment of the present invention, the conventional Model 745 IBM Selectric typewriter can be utilized by modifying the carriage escapement rack, the carriage return spring and the platen index assembly. As shown in FIG. 4, the Selectric typewriter includes a platen 105 which normally carries and vertically moves a printout sheet a portion of which is represented at P. A movable carriage represented at 106 has a replaceable spherical type head or print head 107 mounted thereon. The carriage 106 is coupled to a cable drum 109 on escapement shaft 110 by a cable 111 which extends around the drum 109 and a plurality of appropriately spaced pulleys 112, 113, and 114. To the above conventional typewriter structure there is added the horizontal stepping motor 13 which is drivingly connected through a three-speed gear transmission 116 to the escapement shaft 110 to step the carriage 106 a selected number of times for a preselected amount or distance of horizontal travel.

The horizontal spacing stepping motor 13 is mounted in a manner described more fully hereinafter and is adapted to pivot about shaft 201 and to longitudinally slide on shaft 201 to drive the carriage 106 through a the three-speed gear transmission 116. The output shaft 117 of the horizontal stepping motor 13 carries a main gear 118 which meshes with a larger gear 119 on a shaft 121 arranged parallel to the motor output shaft 117, the shaft 121 having a smaller gear 122 at the end opposite to the gear 119 which meshes with one of three coaxially aligned gears 123, 124, and 125 mounted in a cluster and coupled to the escapement shaft 110 of cable drum 109. The gear ratios of the three gears on the cluster 123, 124 and 125 are chosen such that, for instance, a fifteen-degree step of the horizontal stepping motor 13 will provide pitch increments of 1/72, 1/84, or 1/96 inch of carriage escapement. The horizontal stepping motor 13 in response to a selected number of pulses will step a corresponding number of times to space from the character which has been printed to the next character to be printed. For example, for a wide character, such as, an upper case M it is necessary to step nine times from the left side of that character before the impression of the next character. The horizontal stepping motor 13 drives the carriage 106 to the right and a conventional carriage return mechanism, not shown, drives the carriage to the left, the latter being a conventional Selectric typewriter structure and operation.

The vertical stepping motor 12 is coupled to a speed-reducing gear train 131 which in turn is coupled to the platen 105. The gear train 131 includes a worm gear 132 on motor shaft output 132′, a gear 133 on a cross-shaft 134 meshing with the worm gear 132, the cross shaft 134 having a gear 135 on the opposite end and, an intermediate gear 136 intermeshes between gear 135 and a gear 137 on the platen 105. In this arrangement, each time the vertical stepping motor 12 rotates an increment the platen 105 rotates a preselected distance as determined by the gear train 131. Or instance, in a preferred form each increment of rotation of the platen 105 is 0.0138 inch.

As shown in FIG. 5a, the slide-pivot mount for the horizontal stepping motor 13 includes an inverted channel-shaped base 149 having a pair of spaced upstanding lugs 151 and 152. The motor housing is modified by attaching a cradle-like member thereto including forward and rear end plates 153 and 154, respectively, connected together along the underside of the housing by a bottom plate 155. The forward end plate 153 forms an end cap for the front end of the motor housing and the rear end plate 154 overlays the existing end cap of the motor housing. The forward end plate 153 has outwardly projecting upper and lower lug portions 156 and 157 and the rear end plate 154 has upper and lower lug portions 158 and 159. The spaced lower lug portons 157 and 159 have a shaft 201 fixedly secured thereto, the shaft 201 extending through and being slidable in the base plate lugs 151 and 152 thereby allowing the motor housing both to pivot and slide longitudinally relative to the base 149. The drive shaft 121 is journaled in the spaced upper lug portions 156 and 158 in such a way that it rotates therein but does not move axially relative to the horizontal stepping motor 13. In this way the drive shaft 121 will move axially only with the axial movement of the horizontal stepping motor 13.

Figure 5:
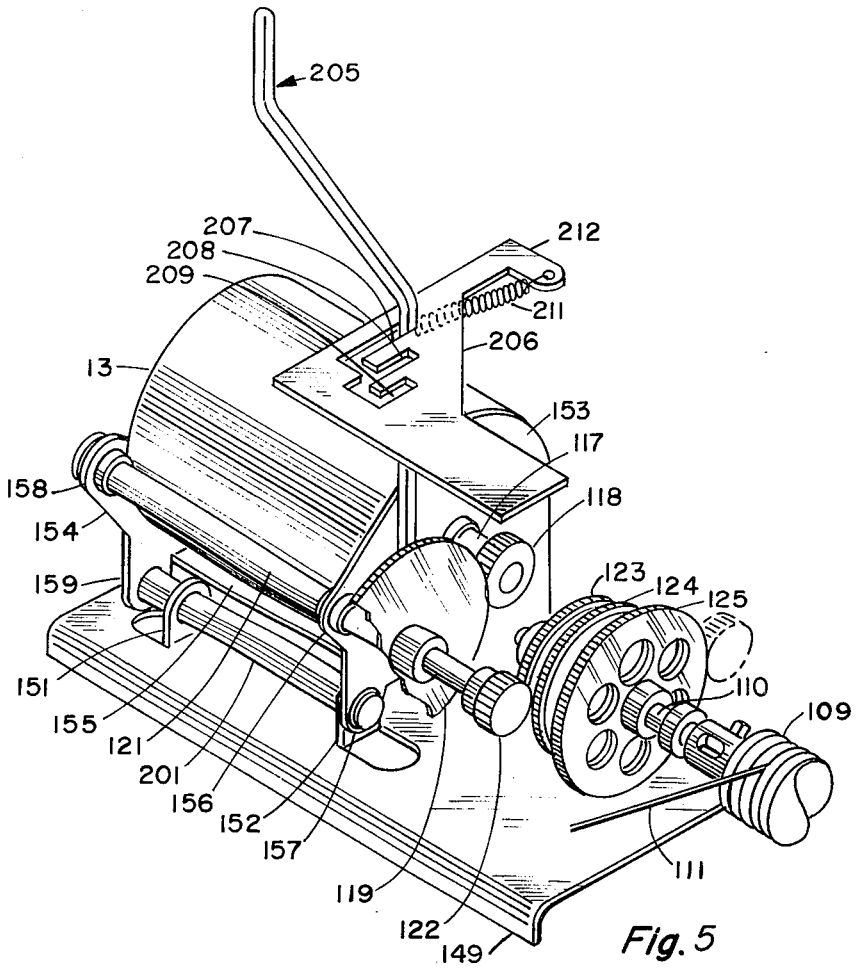
FIG. 5 is a fragmentary perspective view of a horizontal stepping motor and slide-pivot mounting, pitch selector lever and gearing assembly for the horizontal movement of the carriage.
Figure 6:
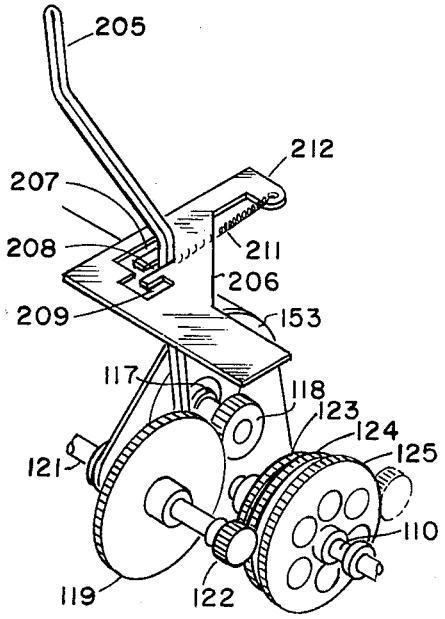
FIG. 6 is a fragmentary perspective view of a portion of the horizontal stepping motor with the pitch selector lever set for the intermediate increment of horizontal movement.
Figure 7:
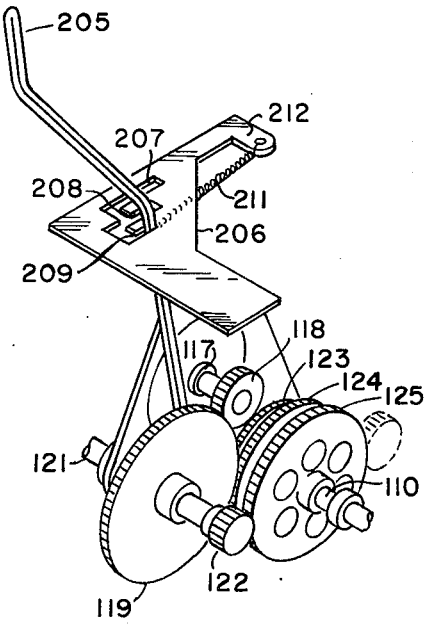
FIG. 7 is a fragmentary perspective view of a portion of the horizontal stepping motor with the pitch selector lever set for the smallest step or increment of horizontal movement for the carriage.

An upright shift lever 205 is fixedly secured at its lower end to the end plate 153 for the manual pivoting and sliding of the motor 13. The limits of movement of the horizontal stepping motor 13 are established by a stationary slotted plate 206 horizontal stepping attached to stationary structure, not shown of the typewriter (not shown). The slotted plate 206 has three stepped slots 207, 208, and 209 through which the lever 205 will extend, with each slot opening into the other for the selective placement of the lever 205 into one of the slots 207, 208 and 209, the lever 205 positioning the output gear 122 in engagement with one of gears 123, 124, and 125 respectively. A tension spring 211 interconnects a lug 212 on the plate 206 and the lever 205 to bias the lever 205 into a selected one of the stepped slots 207, 208 and 209. As shown in FIG. 5, positioning of the lever 205 in the slot 207 establishes meshing of gear 122 205 with gear 123. In FIG. 6 the setting of the lever 205 in slot 208 positions gear 122 in meshing engagement with gear 124 and in FIG. 7 the setting of lever 205 in slot 209 positions the output gear 122 in meshing engagement with gear 125. To reset the spacing increment the lever 205 is moved against the force of the spring 211 to one side to pivot the horizontal stepping motor 13 and output shaft 117 and then moved axially of the output shaft 117 to position the output gear 122 in meshing engagement with one of the gears 123, 124 and 125 of the cluster.

Again, the operation of the above described apparatus may be broken into a keyboard operation for inputting information into the device and a processor or computer-controlled operation for printing out the data. During data input to the computer 14, the keyboard 21 and printer 11 is operated as a conventional terminal. The only special command to the computer 14 after establishing the link-up is the line length of the finished output which is input over line 35. The text to be proportionally spaced and left-and-right justified is typed in a conventional manner without regard to the left-and-right margins. The hard copy output of the data entered is no different than the conventional typewriter output with the horizontal stepping motor 13 stepping the same number of steps for each character. For the carriage return, the horizontal stepping motor 13 is disabled to permit return by the carriage return spring as described. Upon arrival at the left margin, the conventional margin stop [not shown] on the typewriter 302 preferably opens a switch, not shown which for convenience may be engaged by the platen 105 and reapplies the power to the horizontal stepping motor 13. The horizontal stepping motor 13 then drives the carriage 106 to the right until the left margin switch, not shown again closes. Indexing occurs during carriage travel. When the decoder 31 receives the index code signal a fixed number of pulses is transmitted to the vertical stepping motor 12 as above described.

For the computer controlled operation after the entry is complete, the operator enters "end of transmission" signal, inserts and aligns the medium upon which the final copy is to be printed, sets the carriage 106 at the desired left margin, and enters a command to the computer 14 to send out the final copy data.

In summary, horizontal spacing following each character is established by the horizontal stepping motor 13, which drives the carriage 106 through a threespeed gear transmission 116 geared to provide a selected number of steps or increments, such as, 1/72, 1/84 and 1/96 inch which corresponds with conventional typing heads. The shift lever 205 enables the operator to select the spacing increment required for a particular type sphere or print head 10. During input to the computer 14 the lever is set on the 1/72 setting and the carriage 106 steps seven steps for each character. During receipt of assembled data from the computer 14, the apparatus prints, with each character followed by a horizontal space signal for the character which is routed through the decoder 31 to control the number of steps of the horizontal stepping motor 13. In the complete sequence of operation the operator installs the standard typewriter print head 107 and sets the spacing to the 1/72 increment setting. The terminal apparatus is switched to remote operation and a computer link is established. Normal file building and text editing operatons are performed. When the text input is complete the operator (a) commands the computer 14 to run off a final copy, (b) changes the print head 107 to the desired font, (c) sets the proper horizontal spacing increment with lever 205, (d) inserts the sheet around the platen 105 for a final copy 300 and (e) inputs a carriage return command from the keyboard 21. The computer 14 then begins transferring the processor information to the printer 11 and stepping motors 12 and 13 to print out the final copy 300.

Although the present invention has been described with a certain degree of particularity, it is understood that the present disclosure has been made by way of example and that changes in details of structure may be made without departing from the spirit thereof.

What is claimed is:

1. In an automatic justifying typewriter including a typewriter printer having character printing means capable of printing characters of differing horizontal widths, printer control means for actuating said character printing means to impress selected characters on a print-out medium, a rotatable platen for vertical positioning of the print-out medium, and means for originating electrical signals corresponding to the character to be printed, the improvement comprising:

incremental drive means for effecting incremental horizontal movement between said character printing means and said print-out medium, a data source connected to receive said character corresponding electrical signals for selectively and successively producing coded printing control signals each corresponding to a particular character to be printed and coded spacing control signals having a count corresponding to a preselected horizontal space for each respective character to be printed, said printer control means including means responsive to each said printing control signal to actuate said character printing means to print the corresponding character on said print-out medium, means including counter means for storing said count of said coded spacing control signals, and means responsive to said spacing control signals in said storing means for causing said incremental drive means to effect relative horizontal motion between said character printing means and said print-out sheet in a number of increments corresponding to the said count of said stored spacing control signals.

2. Apparatus in accordance with claim 1 wherein said incremental drive means includes a stepper motor coupled for effecting relative horizontal motion between said character printing means and said print-out sheet, and said spacing control signal responsive means includes means for introducing to said stepper motor a number of actuating pulses corresponding to said count stored in said counter.

3. Apparatus in accordance with claim 2 wherein said stepper motor is coupled to said character printing means by a variable pitch transmission having a plurality of gear settings selectable for adjusting the width of horizontal movement of said character printing means for each increment of relative motion of said stepping motor.

4. In an automatic justifying typewriter wherein a printer includes a horizontally movable carriage for interchangeable mounting of single element print heads of variable type fonts, a rotatable platen provided for a print-out sheet which is selectively engaged by said single element print head, and a keyboard for producing coded electrical printing signals representative of printing and functional operations performed by said keyboard including characters, carriage return and index, the combination therewith comprising:

horizontal stepping motor means coupled to said carriage and being operative to advance said single element print head in horizontal increments either for forward or reverse escapement, said horizontal stepping motor means including a horizontal stepping motor having an output shaft and horizontal drive means on the output shaft of said horizontal stepping motor, vertical stepping motor means coupled to said platen and operative to rotate said platen in vertical increments to index said print-out sheet, data source means for storing the coded electrical printing signals produced by said keyboard including processing means for producing a horizontal character spacing signal in a number of increments proportional to the width of each said character, said processing means being further operative to produce functional operation signals for word spacing after each word received, indexing and backspacing, each of said functional operation signals including a number of increments corresponding thereto, data entry means for successively applying in sequence one of said coded printing signals followed by at least one of said functional operation signals from said data source means, printer gate means responsive to said data entry means for selectively gating said coded printing signals from said data entry means to said printer, stepping motor gate means responsive to said data entry means for selectively gating said functional operation signals to one of said horizontal and vertical stepping motor means, said stepping motor gate means including counter means for storing signals corresponding to said increments of said horizontal character spacing signal and said functional operation signals, and control means coupled between said data entry means and said printer gate and stepping motor gate means to alternately gate said coded printing signals to said printer and said functional operation signals and character spacing signals to said stepping motor gate means respectively, said control means including means for actuating the print head to print a character followed by stepping said horizontal stepping motor means a predetermined number of horizontal increments corresponding to the number of increments identified by said character spacing signal and said functional operation signals in accordance with the content of said counter means.

5. In an automatic justifying typewriter according to claim 4, wherein said control means includes a flip-flop circuit responsive to the output of said data entry means to selectively couple the signals received from said processing means of said data source means to said printer gate means and said stepping motor gate means.

6. In an automatic justifying typewriter according to claim 4, wherein said stepping motor gate means includes a step oscillator for generating a train of stepped pulses for energizing said horizontal stepping motor in accordance with the content of said counter means responsive to said character spacing signal as provided to control the number of times said step oscillator energizes said horizontal stepping motor.

7. In an automatic justifying typewriter according to claim 6, said stepping motor gate means including means responsive to an indexing signal produced by said processing means to disable said horizontal stepping motor means and energize said vertical stepping motor means to advance said vertical stepping motor means in vertical increments in accordance with the number of counts in said counter means.

8. In an automatic justifying typewriter according to claim 6, said horizontal and vertical stepping motor means each including windings and motor control circuit means for controlling the sequence of energization of the windings of said horizontal and vertical stepping motor means to control the direction of advancement of each of said horizontal and vertical stepping motor means.

9. In proportional printing apparatus including a printer having character printing means and printer control means for actuating said character printing means to impress selected characters on a print-out sheet or the like, the improvement comprising:

coupling means including first gear means for providing horizontal relative movement between said character printing means and said print-out sheet, a stepping motor having second gear means attached to the output shaft thereof, said first and second gear means intermeshing at a plurality of positions for providing motion transfer therebetween at different ratios as between said positions, means for mounting said stepping motor for pivotal and axial movement, means for moving said stepping motor in said mounting means for selecting one of said intermeshing positions of said first and second gear means, a data source for selectively and successively producing coded printing control signals each corresponding to a particular character to be printed and coded spacing control signals including counts corresponding to a preselected horizontal space for each respective character to be printed, said printer control means being operatively associated with said character printing means and being responsive to each printing control signal to actuate said character printing means to print the said character identified thereby, and means responsive to each said spacing control signal for a character to actuate said stepping motor for effecting relative motion by said coupling means in increments identified by said counts of said spacing control signals and in accordance with the position of said selecting means.

10. Apparatus in accordance with claim 9 wherein said first gear means includes a plurality of gears each having a different diameter relative to the other of said gears of said plurality, said second gear means on said stepping motor is a single drive gear, and said selecting means includes means for pivoting said stepping motor so as to disengage said first and second gear means while permitting axial movement thereof for selecting another intermeshing position between said single drive gear and one of said plurality of gears.

11. Apparatus in accordance with claim 10 which further includes biasing means for applying a force between said first and second gear means in an intermeshing direction, said selecting means including means for overcoming said biasing means force whenever the said intermeshing position is to be changed.

12. In an automatic justifying typewriter wherein a printer includes a horizontally movable carriage for interchangeable mounting of single element print heads of variable type fonts, a rotatable platen provided for a print-out sheet which is selectively engaged by said single element print head, and a keyboard including encoding logic means for producing coded printing signals representative of printing and functional operations performed by said keyboard, the combination therewith comprising:

horizontal stepping motor means coupled to said carriage and operative to advance said single element print head in horizontal increments either in forward or reverse escapement, said horizontal stepping motor means including a horizontal stepping motor having an output shaft, horizontal drive means on the output shaft of said horizontal stepping motor, and shift means to selectively position said horizontal stepping motor and said horizontal drive means for a plurality of pitch settings to conform the escapement distance of each step of said horizontal stepping motor means to the font size on said single element print head, said shift means including variable pitch transmission means coupled to said horizontal drive means, said variable pitch transmission means having a plurality of gear settings corresponding to said plurality of pitch settings cooperating with said shift means such that said horizontal drive means operates to engage one of said gear settings, horizontal stepping motor control means being operative to apply stepping pulses to said horizontal stepping motor means to control forward and reverse stepping of said horizontal stepping motor thereby to effect forward and reverse stepping escapement of said single element print head for a number of steps corresponding to the stepping pulses applied to said horizontal stepping motor means, vertical stepping motor means coupled to said platen and operative to rotate said platen in vertical increments to index said print-out sheet, vertical stepping motor control means being operative to apply stepping pulses to said vertical stepping motor means to control indexing of said platen for a number of steps corresponding to the stepping pulses applied to said vertical stepping motor means, data source means for storing said coded printing signals and including processing means for determining the space requirements of each said character, for producing a character spacing signal in a number of increments proportional to the width of each said character, and for producing functional operation signals including word spacing signals after each word received, a carriage return signal at the end of each line, indexing and backspacing signals, data entry means for successively applying one of said coded printing signals and functonal operation signals, followed by said character spacing signal and after each word signal followed by said word spacing signal sequentially from said data source means, printer gate means for selectively gating said coded printing signals from said data entry means to said printer, said coded printing signals being operative with said printer to print said character on said print-out sheet, stepping motor gate means for selectively gating said character and word spacing signals to said horizontal stepping motor control means and for selectively gating said functional operation signals to said vertical stepping motor control means, said stepping motor gate means including a step oscillator for generating a train of step pulses for energizing both said horizontal and vertical stepping motor control means and counter means responsive to said character spacing signal to control the number of times the said step oscillator energizes the said horizontal stepping motor control means, and control means between said data entry means, said printer gate means and said stepping motor gate means to alternately gate said coded printing signals to said printer and said functional operation signals and character and word spacing signals to said stepping motor gate means respectively to operate to print a character followed by stepping said horizontal stepping motor means a predetermined number of horizontal increments.

* * * * *